US008601718B2

(12) United States Patent
Classen et al.

(10) Patent No.: US 8,601,718 B2
(45) Date of Patent: Dec. 10, 2013

(54) DRYING METHOD IN A HOUSEHOLD APPLIANCE

(75) Inventors: Egbert Classen, Wertingen (DE); Bernd Müller, Lohr am Maim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1299 days.

(21) Appl. No.: 10/581,238

(22) PCT Filed: Dec. 1, 2004

(86) PCT No.: PCT/EP2004/053211
§ 371 (c)(1),
(2), (4) Date: Feb. 12, 2007

(87) PCT Pub. No.: WO2005/053502
PCT Pub. Date: Jun. 16, 2005

(65) Prior Publication Data

US 2007/0234588 A1 Oct. 11, 2007

(30) Foreign Application Priority Data

Dec. 4, 2003 (DE) ..... 103 56 786

(51) Int. Cl.
*F26B 3/00* (2006.01)
*B08B 3/00* (2006.01)

(52) U.S. Cl.
USPC ..... 34/467; 34/468; 34/472; 34/473; 134/25.2; 134/56 D; 134/57 D; 134/58 D

(58) Field of Classification Search
USPC ..... 34/467, 468, 469, 470, 472, 473, 34/72–79, 604, 606, 607, 134; 134/25.1, 134/25.2, 56 D, 57 D, 58 D
See application file for complete search history.

(56) References Cited

U.S. PATENT DOCUMENTS

| | | | | | |
|---|---|---|---|---|---|
| 2,960,780 | A | * | 11/1960 | Stilwell, Jr. | 68/13 R |
| 4,621,438 | A | * | 11/1986 | Lanciaux | 34/77 |
| 4,800,655 | A | * | 1/1989 | Mori et al. | 34/77 |

FOREIGN PATENT DOCUMENTS

| | | | |
|---|---|---|---|
| DE | 30 21 746 | | 12/1981 |
| DE | 36 26 887 | | 2/1988 |
| DE | 3741652 | A1 * | 6/1989 |
| DE | 198 13 924 | | 9/1999 |
| EP | 0 358 279 | | 3/1990 |
| EP | 0 777 998 | | 6/1997 |

OTHER PUBLICATIONS

Machine translation of DE 3741652 A.*
International Search Report PCT/EP2004/053211.

* cited by examiner

*Primary Examiner* — Jiping Lu
(74) *Attorney, Agent, or Firm* — James E. Howard; Andre Pallapies

(57) ABSTRACT

A method which allows items, contained in a processing chamber, to be effectively and efficiently dried from an economical point of view and the energy consumption to be thus maintained as low as possible, despite a very high drying power. The method includes subjecting a medium in a container to at least one of an evaporation step and a sublimation step, whereby the medium is cooled, and absorbing via a reversibly dehydratable material in a sorber vapor produced by the medium in the container, whereby the reversibly dehydratable material is thereby heated. Air supplied from a processing chamber to the cooled medium is cooled and dehumidified. This air is then heated via contact with the reversibly dehydratable material and fed back into the processing chamber.

1 Claim, 1 Drawing Sheet

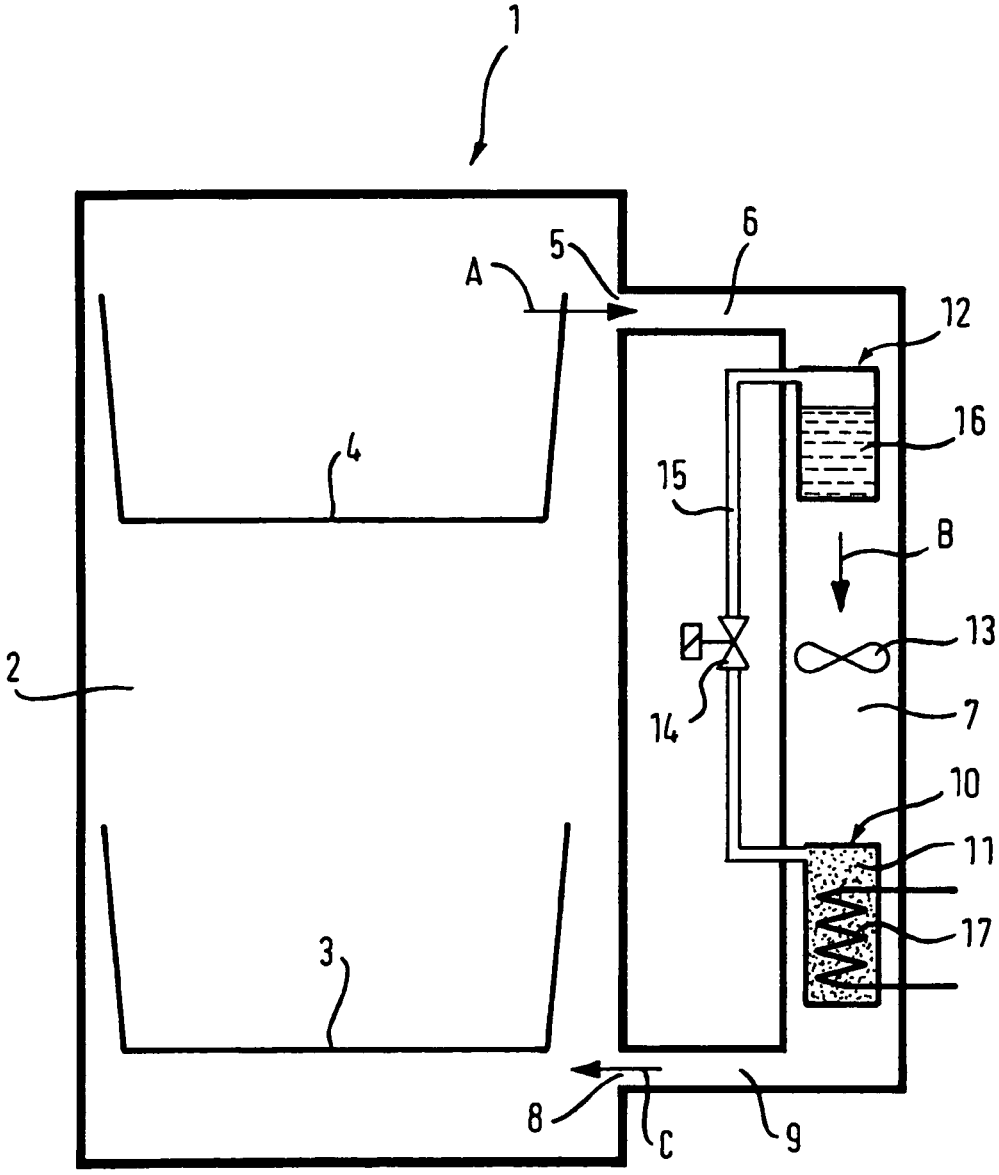
1
2
3
4
5
6
A
7
8
9
10
11
12
13
14
15
16
17
B
C

DRYING METHOD IN A HOUSEHOLD APPLIANCE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention
2. Description of Related Art

The invention relates to a method for drying in a household appliance, e.g. a laundry drier, dishwashing machine or shoe drier.

For drying, for example, it is known that a dishwashing machine has a washing method whose program run consists of at least one partial program step "pre-rinse", a "clean" section, at least one partial program step "intermediate rinse", a partial program step "clear rinse" and a partial program step "dry". The rinsing liquid is heated before or after a partial program step to enhance the cleaning effect. The rinsing liquid is usually heated using electrical heaters in the dishwasher and/or by supplying hot water from the domestic installation. Various drying systems are known for drying washed dishes in a dishwashing machine.

For example, the washed dishes in a dishwashing machine can be dried by own-heat drying if the rinsing liquid is heated in a partial program step "clear rinse" and thus the washed dishes which have undergone a hot clear rinse are dried by themselves by the material-dependent heat content of the washed dishes which has thus built up. In order to achieve this own-heat drying, the rinsing liquid is heated to a certain temperature by a separate heater in the "clear rinse" partial program step and applied to the washed dishes by means of spraying devices provided in the dishwashing machine. As a result of the relatively high temperature of the rinsing liquid in the "clear rinse" partial program step of usually 55° C. to 75° C., it is achieved that a sufficiently large quantity of heat is transferred to the washed dishes so that residual water adhering to said washed dishes vaporises as a result of the heat stored in the washed dishes. The vapor condenses on colder surfaces or is removed from the dishwasher by means of a fan.

In a further known drying device, for example, in a dishwashing machine, a separate heat source, e.g. a hot air fan, is used in the washing container to heat the moist air mixture during the drying process so that the air in the washing container can absorb a larger quantity of moisture. A disadvantage in the heating systems described above according to the prior art described in dishwashing machines, for example, is that the heating of the rinsing liquid is associated with a relatively high energy requirement and the thermal energy required for each heating phase must be produced anew by means of electrical heating elements. The known heating systems also have the disadvantage that the heating of the rinsing liquid in the "clear rinse" partial program step and the processes in the "drying" partial program step are themselves associated with a high energy requirement and the thermal energy required is lost after the drying process because this escapes to the environment.

Dishwashers are known in which the moist air is vented outwards. This is disadvantageous since the surrounding kitchen furniture is damaged and the method requires a possibly unhygienic supply of air into the dishwasher from outside.

Furthermore, dishwashers are known in which the moist air is passed over condensing surfaces on which the moisture condenses before being guided out. This condensation is either passed into the washing container or into special collecting containers.

Known from DE 30 21 746 A1, for example, is a method for operating a dishwashing machine, wherein a heat exchanger connected to the washing container in a heat-conducting manner is supplied with cold fresh water during a partial program step "dry". As a result, a condensation surface is produced on the inside of the washing container on which the moisture condenses and the condensation formed stays in the washing container. Since the temperature difference between the moist air and the fresh water which has been poured in is relatively small and the quantity of fresh water is continuously heated, the disadvantage arises that the condensation of the moist air takes a long time and the condensation performance is continuously reduced and the duration of the partial program step "dry" is long with a moderate drying result. With the duration of the drying process, the bacteria always present on the washed dishes are stimulated to rapid growth by the moist warm environment.

BRIEF SUMMARY OF THE INVENTION

It is thus the object of the present invention to provide a method whereby items to be processed, located in a processing chamber, can be dried effectively and efficiently from an economic perspective so as to keep the energy consumption as low as possible in spite of a very good drying performance.

This object is solved by the method according to the invention having the features according to claim 1. Advantageous further developments of the present invention are characterised in the dependent claims.

The method according to the invention for drying in a household appliance comprises the following steps: a medium in a container evaporates and/or sublimes whereby the medium is cooled, the medium vapor generated in said container is absorbed by a reversibly dehydratable material in a sorber and the reversibly dehydratable material is thereby heated, air from a processing chamber is supplied to the cooled medium, whereby the air is cooled to dehumidify the air by condensation of the moisture contained therein, the cooled and dehumidified air is heated on the reversibly dehydratable material and is fed back into the processing chamber.

The medium is preferably water, for example, and the reversibly dehydratable material is zeolite, for example. Water is a particularly inexpensive and readily available medium.

In another embodiment, the container with the medium and the sorber with the reversibly dehydratable material are interconnected by means of an exchange pipe with a valve for guiding the medium vapor, and the container, the sorber and the pipe preferably form an outwardly closed unit. The absorption of the medium by the reversibly dehydratable material can thereby advantageously be controlled by the valve and as a result of the outwardly closed unit, no medium is consumed.

Appropriately, the air from the processing chamber is guided by a fan via an outlet into pipes to the medium for cooling the air and to the reversibly dehydratable medium for heating the air and back via an inlet into the processing chamber. Thus, the last two steps of the method according to the invention can be carried out using a simple and reliable device which substantially only comprises pipes and a fan.

In another embodiment, the water from the air condensed in the pipes is fed into the processing chamber or into a separate collecting container. The water of condensation can thus be simply removed.

In an additional embodiment, the reversibly dehydratable material is heated for desorption, the medium vapor released from the desorption of the reversibly dehydratable material condenses in the container whereby the medium is heated, air from the processing chamber is passed to the reversibly dehydratable material and back into the processing chamber and the air is thereby heated. Thus, the thermal energy used for desorption of the reversibly dehydratable material can advantageously be used, at least in part, for heating the items to be processed located in the processing chamber, e.g. crockery and/or the processing liquid, e.g. rinsing solution.

Appropriately, air from the processing chamber is fed to the medium and back into the processing chamber, whereby the air is preferably heated. The medium located in the container can then advantageously be used for heating the processing liquid and/or the items to be processed.

The reversibly dehydratable material is advantageously heated by an electrical heating element for desorption.

In a preferred embodiment the air from the processing chamber is guided by means of a fan via an outlet into pipes to the medium for preferably heating the air and to the reversibly dehydratable material for heating the air and back again via an inlet into the processing chamber. It is thus possible to guide the air to the medium and to the reversibly dehydratable material using a simple and reliable device.

Advantageously, during a partial program step, e.g. "clean" or "pre-rinse", this is carried out using items to be heated, for example, crockery or laundry, and/or using processing liquid, for example, washing solution so that the thermal energy used for desorption can be used at least in part for heating the items to be processed and/or the processing liquid.

BRIEF DESCRIPTION OF THE SEVERAL VIEWS OF THE DRAWING(S)

The invention is explained hereinafter with reference to the exemplary embodiment shown in FIG. 1.

FIG. 1 is a schematic cross-section through a dishwashing machine for carrying out the method according to the invention.

DETAILED DESCRIPTION OF THE INVENTION

The household appliance, e.g., the dishwashing machine 1 has a closed air cycle which leads through the pipes 6, 7, 9 as well as the processing chamber 2 with crockery baskets 3, 4. The items to be processed, e.g. dishes (not shown) are located in the processing chamber 2. Located in the upper area of the processing chamber, e.g. washing container 2 is an outlet 5 from the washing container 2 in which air flows into the pipe 6, see arrow A. Located in the lower area of the washing container 2 is an inlet 8 in which the air from the pipe 9 flows into the washing container 2, see arrow C. Located between the pipes 6 and 9 is the pipe 7 with the fan 13 which conveys the air in the pipe 7 in the direction of flow according to arrow B. Located at the end of the pipe 6 in the pipe 6 is a container 12 filled with a medium, e.g. water 16 or ice. Heat exchange between the air in the pipe 6 and the water 16 or ice in the container 12 is thereby possible. Located in the pipe 9 is a sorber 10 which contains reversibly dehydratable material 11, e.g. zeolite. An electric heating element 17 is provided in the sorber 10 which heats the reversibly dehydratable material 11 for desorption if necessary. The sorber 10 and the container 12 are interconnected by means of an exchange pipe 15, a valve 14 being disposed in the exchange pipe 15 in order to interrupt the connection between the container 12 and the sorber 10.

With the closed air system, exchange of contaminated air from the environment is eliminated, thus preventing any back-contamination of the treated items.

It is known that a dishwashing machine has a washing method whose program run generally consists of at least one partial program step "pre-rinse", a partial program step "clean", at least one partial program step "intermediate rinse", a partial program step "clear rinse" and a partial program step "dry".

According to the invention, in a partial program step "dry" air from the washing container 2 is passed via the inlet 5 through the pipes 6, 7 and 9 and back via the inlet 8 into the washing container 2 with the aid of the fan 13. In the partial program step "dry" wet dishes to be dried with moist air are located in the washing container 2. The valve 14 in the exchange pipe 15 is preferably opened.

The reversibly dehydratable material 11 contained in the sorber 10 has a relatively high capacity for moisture. If the container 12 is now connected to the sorption column 10 by opening the valve 14, the reversibly dehydratable material 11 absorbs a large quantity of the water 16 contained in the container 12 in a short time and the remainder of the water in the container 12 is severely cooled by latent heat of evaporation, e.g. until it freezes. The water 16 or ice in the container 12 evaporates or sublimes and the water vapor reaches the sorber 10 via the exchange pipe 15. In the sorber 10 the water vapor is absorbed by the reversibly dehydratable material 11. The reversibly dehydratable material 11 and therefore the sorber 10 is heated by the condensation heat produced.

As a result of the cooling of the container 12, a very large temperature difference is produced between the moist air and the condensation surface formed on the inside of the pipe 6. The moist air passed out from the washing container condenses as a result. The released condensation must be led off, e.g. into the washing container 2 or into a separate storage container (not shown). The cooled air from which moisture has been removed at the container 12 is passed via the pipe 7 to the sorber 10. The sorber 10 has a severely elevated temperature, e.g. 140° as a result of the condensation heat produced. This results in heating of the air passed through the pipe 9 whereby the relative air moisture decreases further and the moisture absorption capacity of the air increases substantially. This dry and warm air is fed into the washing container 2 via the inlet 8 and can heat and dry the dishes to be dried here. The air fed in via the inlet 8 absorbs moisture in the washing compartment 2 and cools down and is then passed into the pipe 6 via the outlet 5 in a closed cycle.

The valve 14 is preferably opened during the partial program step "dry" so that the cooling of the container 12, the heating of the sorber 10 and the circulation of the air through the pipes 6, 7 and 9 take place simultaneously. However, the valve 14 can already have been opened before the beginning of air circulation so that at the beginning of circulation of the air for drying, the container 12 is correspondingly cooled and the sorber 10 is heated and thus the complete drying capacity is available from the beginning. Furthermore, the valve can also be at least partly closed during circulation of the air because no additional cooling or heating is required as a result of the heat and cold storage capacity of the container 12 and the sorber 10.

During other part program steps which require no drying, the valve 14 normally remains closed because any unnecessary heating or cooling of the container 12 or sorber 10 would thereby be achieved.

The reversibly dehydratable material 11 in the sorber 10 must be heated to very high temperatures for desorption, which is accomplished using the electric heating element 17. In this case, the stored liquid emerges as hot water vapor which reaches the container 12 via the exchange pipe 15 when the valve 14 is open, said container acting as a condenser because the hot water vapor condenses in the container 12. The container 12 and the water 16 is heated by the condensation heat. The sorber 10 is heated to high temperatures, e.g. 200°-300° by the electrical heating element. According to the invention, the thermal energy used for desorption is at least partly used for heating the rinsing liquor and/or the dishes in a partial program step using the rinsing liquor to be heated or already heated rinsing liquor, e.g. "clean" or "pre-rinse". For this purpose, during the desorption of the sorber 10 the fan 13 is preferably switched on and the air from the washing container 2 is circulated through the pipes 6, 7 and 9 according to the arrows A, B and C. In this case, the air at the container 12 and especially at the sorber 10 is heated. The fan 13 is preferably only switched on when the temperature in the container 12 is higher than that in the washing container 2. It is also possible that during the desorption phase the air is guided around the container 12 by means of a bypass pipe (not shown) until the temperature in the container 12 is higher than that in the washing container 2. The heating of the air in the container 12 and especially in the sorber 10 is largely sufficient to adequately heat the rinsing liquor and/or the dishes. Thus, any further heating can be largely dispensed with and the energy used for desorption can be almost completely used for heating the rinsing liquor and/or the dishes apart from the small amount of energy required to overcome the binding forces between water and reversibly dehydratable material. Thus, any further heating can largely be dispensed with. In addition to the energy saving, efficient cleaning of the items for washing is also ensured. Advantageously, the washed dishes can thereby be effectively dried with a low heat content, e.g. plastic parts because no heating is required in the partial program step preceding the "dry" partial program step. The rapid drying also allows severely reduced bacteria growth or even completely prevents bacteria growth which advantageously affects the hygiene conditions on the cleaned dishes.

The present invention provides a dishwashing machine which allows the washed dishes located in the washing container to be cleaned and dried effectively from an economic perspective and so keep the energy consumption as low as possible.

The invention claimed is:

1. A method for drying in a dishwasher, the method comprising:

(a) subjecting a medium in a container to at least one of an evaporation step and a sublimation step, whereby the medium is cooled;

(b) absorbing vapor, that is produced by the medium in the container, via a reversibly dehydratable material in a sorber, whereby the reversibly dehydratable material is heated;

(c) supplying air from a processing chamber of the dishwasher to the cooled medium, whereby the air is cooled and dehumidified via contact with the cooled medium; and (d) heating the cooled and dehumidified air on the reversibly dehydratable material and feeding back the heated air into the processing chamber of the dishwasher;

the method further comprising:

heating the reversibly dehydratable material for desorption to condense the medium vapor that has been released via the desorption of the reversibly dehydratable material in the container whereby the medium is heated, and passing air from the processing chamber to the reversibly dehydratable material and back into the processing chamber, whereby the air is heated; and desorbing the reversibly dehydratable material in the sorber via thermal energy and applying at least a portion of the thermal energy to at least one of the items to be processed and a processing liquid, wherein the items to be processed are heated during a partial program step that is a clean step or a pre-rinse step, and wherein the processing liquid is a washing solution or a non-washing solution.

* * * * *

UNITED STATES PATENT AND TRADEMARK OFFICE

CERTIFICATE OF CORRECTION

PATENT NO. : 8,601,718 B2
APPLICATION NO. : 10/581238
DATED : December 10, 2013
INVENTOR(S) : Classen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1496 days.

Signed and Sealed this
Twenty-second Day of September, 2015

Michelle K. Lee

Michelle K. Lee
*Director of the United States Patent and Trademark Office*